United States Patent [19]

Jones

[11] 4,037,639

[45] July 26, 1977

[54] THERMAL BARRIER

[76] Inventor: J. Paul Jones, 644 Valley View Lane, Wayne, Pa. 19087

[21] Appl. No.: 739,528

[22] Filed: Nov. 8, 1976

[51] Int. Cl.[2] ..... E06B 9/08

[52] U.S. Cl. ..... 160/133; 160/232; 160/235

[58] Field of Search ..... 160/133, 232, 235

[56] References Cited

U.S. PATENT DOCUMENTS

| | | | |
|---|---|---|---|
| 878,341 | 2/1908 | Cahill | 160/236 |
| 1,936,300 | 11/1933 | Guss | 160/232 |
| 1,989,513 | 1/1935 | Greegor | 160/235 |
| 2,926,727 | 3/1960 | Purdy | 160/232 |
| 2,958,083 | 11/1960 | Shook et al. | 160/232 |

*Primary Examiner*—Peter M. Caun

*Attorney, Agent, or Firm*—Frederick J. Olsson

[57] ABSTRACT

Moveable barrier to cover and uncover building window and the like to control thermal energy transmission. Barrier includes group of elongated hollow, slats mounted on tracks and connected by pivots. Slats form generally rectangular shaped moveable panel. Material of tracks and slats and the dead air spaces of slats form thermal barrier. Panel can be moved to cover and uncover area. Pivots provide for panel to be rolled up when moved to the uncover position.

5 Claims, 13 Drawing Figures

THERMAL BARRIER

This invention relates in general to insulating barrier means and, in particular, to a barrier including a sliding air-insulated panel made up of pivotly interlocking segments or slats. The pivots allow the slats to slide around corners, or to be curled up into a valance box, etc., for out-of-sight storage.

The hollow slats are lens-shaped in cross section and are typically made from very thin-walled plastic extrusions, which are very light for their rigidity, and which are strong enough to span wide window or door frames.

Typically, the sliding segmented panels are used to seal off and insulate windows from heat loss at night, and to shield the entry of direct sunlight during periods when solar heat is excessive.

The panel when installed at some distance behind conventional windows or Thermopane windows will provide two additional insulating air spaces and two additional insulating membranes which, in concert, can reduce the heat loss to less than a fifth of a single Thermopane glass window.

The sliding panels are inexpensive and attractive panels can take the place of conventional roll-down, venetian blinds or outside shutters. When used in retrofit installation, the panel can be wound up into a valance box which has end plates that support the roll-up mechanism.

It is common knowledge that an average of 80% of all energy that is put into a building for heating purposes escapes via the windows, doors, etc. This percentage escape thru windows may become even higher if there is good insulation in the walls, roof, etc.

It is, therefore, one object of this invention to provide an inexpensive and attractive insulating system which can be retrofitted to most existing windows, doors, and like apertures to greatly decrease the heat loss via the apertures in the building.

During the summer season, when homes or buildings are overheated by solar energy that comes thru windows, glass enclosed porches, etc., electrical energy is consumed when air conditioning equipment is used to pump the accumulated heat back out of the building.

It is therefore another object of this invention to provide a simple means for insulating homes and buildings from the "hothouse" effect, by diverting solar energy that would be collected through clear panels, and which would require electrical energy to move the heat out of the building through air conditioning machinery.

During the winter season it would be highly desirable to have rooms (atriums) or courtyards covered with glass roofs or apertures to admit the sun for vegetation and to collect solar energy in a natural way. Glass-roofed structures have the general problem of condensation when the sun is not shining directly on the aperture; especially when the structure is metallic, which can conduct the outside cold.

It is therefore another object of the invention to provide a moving panel system which will prevent condensation by insulating the moist inside air from the glass panels on wooden beams with two plastic membranes and still-air space, plus forming an additional second air space between the shutters and the glass, which can be ventilated, if necessary.

It is still another object of this invention to provide an inexpensive and esthetically acceptable insulating system of the kind mentioned which can be easily installed, cleaned and maintained by people who are not mechanically inclined.

Most of the solar energy collecting devices which are presently being used, consist of a transparent cover or aperture for admitting the sunlight, and heat absorbing collectors located some distance behind these transparent "windows". The energy flow into the system can only take place when the sun is shining directly thru the aperture into the collectors. As soon as the sun is removed, for even relatively short periods, the heat absorbing collectors will immediately begin radiating energy out of the aperture which greatly contributes to the inefficiency of the system.

It is, therefore another object of this invention to provide a simple and inexpensive means for automatic insulating solar panels and other similar energy control devices. The invention can automatically close off the heat flow in either direction, when adverse conditions, such as cloud cover, or night fall, would begin to contribute to the inefficiency of the system. In terms of thermal engineering, the new system adds two additional insulating air spaces, plus two insulating membranes. Existing engineering data shows a decrease in heat loss of approximately 20 % for each additional insulating air space or membrane.

Other advantages and objectives will be apparent from the description below taken in conjunction with the following drawings wherein.

FIGS. 1 thru 4 illustrate some typical applications of the invention.

Figure 1:
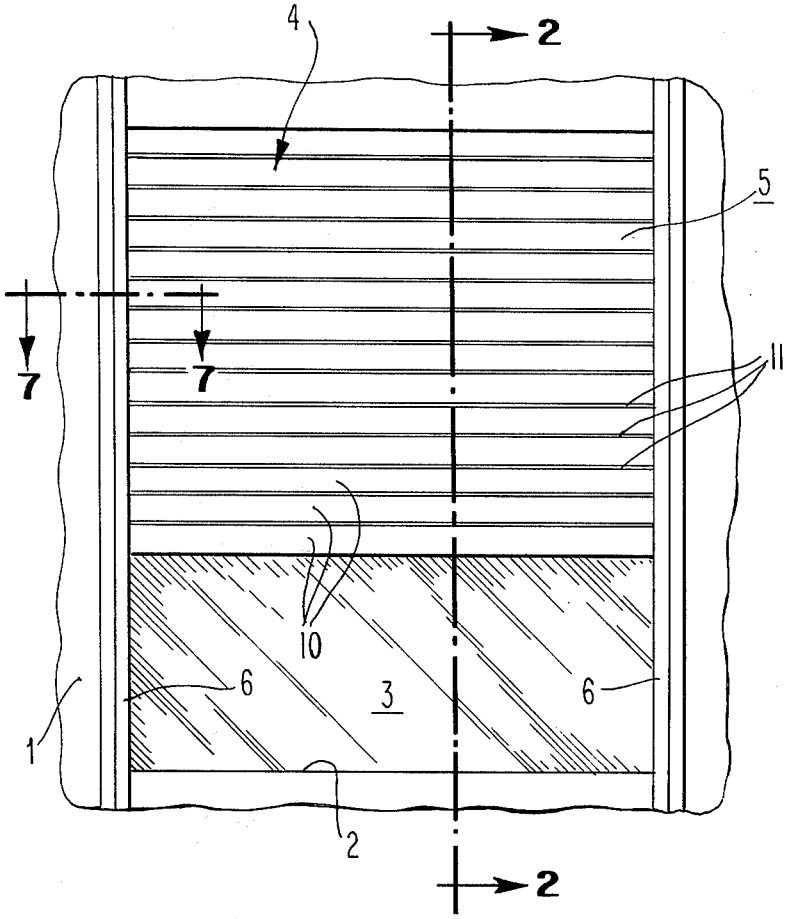
FIG. 1 is an elevational view diagramatically illustrating the invention as applied to a building window.
Figure 2:
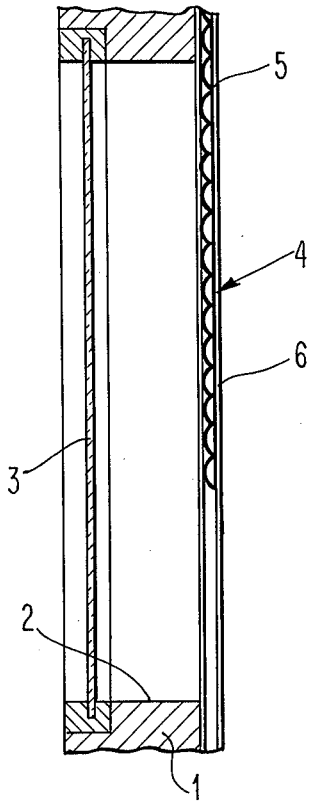
FIG. 2 is a side elevational view of the arrangement of FIG. 1.

In FIGS. 1 and 2 a building wall 1 has an aperture 2 closed off by window 3. The thermal barrier 4 of the invention is mounted on the inside of the wall.

The barrier 4 includes the panel 5 slideably mounted in the tracks 6, secured to the inside of wall. The panel 5 is made up of slats 10 and pivot means 11 interconnecting adjacent slats. The panel 4 is adapted to be moved on the tracks to cover and uncover the aperture 3 so as to control the flow of thermal energy thru the aperture.

Figure 3:
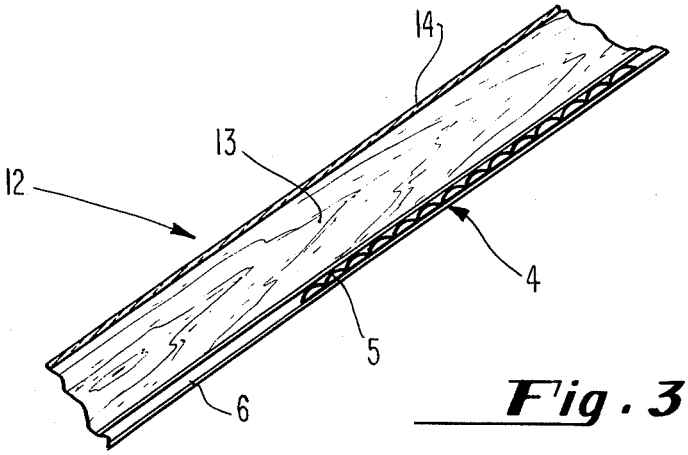
FIG. 3 is a side elevational view diagramatically illustrating the invention as applied underneath a glass roofing arrangement such as a greenhouse.

In FIG. 3 the transparent roof 12 of a conventional green house includes a plurality of spaced-apart beams one in which indicated at 13 and a sealed glass cover or aperture 14 extending between the beams. The barrier 4 of the invention is mounted between one or more pairs of adjacent beams. Similar to FIG. 1, the barrier includes the panel 5 mounted in tracks 6 secured to the underside of the beams. The panel 5 is moveable so as to cover and uncover the aperture and thus control the flow of thermal energy.

Figure 4:
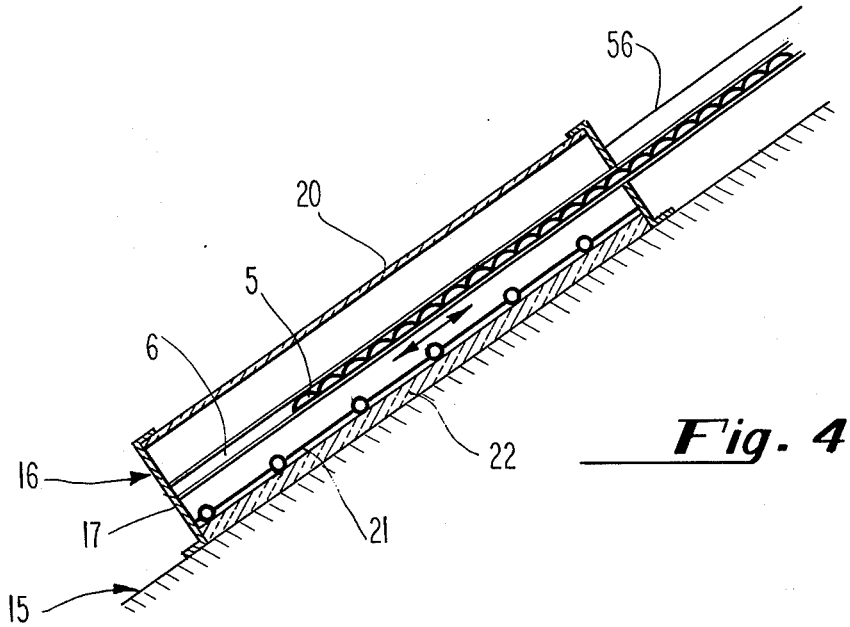
FIG. 4 is a side elevation view diagramatically illustrating the invention as applied in a typical solar energy panel system.

In FIG. 4 the roof 15 of a building mounts a solar energy heatng panel 16. The panel has a housing 17 which mounts glass cover or aperture 20. A collector 21 is supported on the insulation 22. The barrier 4 is disposed between the glass 20 and collector 21. The tracks 6 are mounted on the housing 20 and support the panel 5. The panel 5 is moveable to cover and uncover the collector 20.

In connection with the applications of FIGS. 1–4, the invention contemplates that the panel, when it uncovers the aperture, be moved into a storage medium. The panel may be moved by hand and by a power drive system. As to hand operation the panel 5 in FIG. 1, for example, may be pushed up and pulled down without difficulty. For the applications of FIGS. 3 and 4, power drive systems are preferably employed. A drive system will be described later.

While in the examples of FIGS. 1 thru 4, I have shown a single panel as covering and uncovering the aperture, it will be understood that a pair of panels one on each side of the aperture with ends meeting at the center in the cover condition may be employed.

Figure 5:
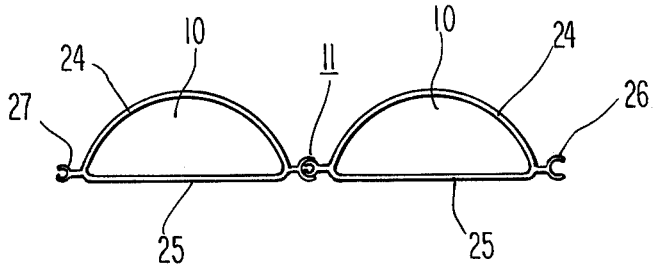
FIG. 5 is a cross sectional view of a pair of slats of the invention.

In FIG. 5, a pair of slats 10 are connected by the pivot means 11. Each slat is lens shaped having a convex side 24 and a planar side 25. Perferably, the convex side 24 faces the outside and the planar side 25 faces the inside of the building, equipment or device on which the barrier is employed. The lens shape is important from the standpoint of structural strength. The shape provides a slat can have a substantial length without sagging and so is readily adaptable to wide apertures even up to 6 feet. Preferably, the slats are extruded from rigid PVC plastic and have a wall thickness between 0.020 and 0.025 inches.

The planar side 25 is important because it forms an air seal (as explained later) is easy to clean and has desirable aesthetic appearance.

The pivot means 11 includes a socket section 26 and insert section 27. The socket section and insert section are co-extensive with the length with the slat. It will be apparent, the socket and insert sections engage via circular surfaces which permit the slats to rotate relative to one another. Preferably the pivots sections 26 and 27 are extruded and at the same time as the sides 24 and 25. As integrally extruded the socket and insert section contribute to the structural strength of the slat.

Figure 6:
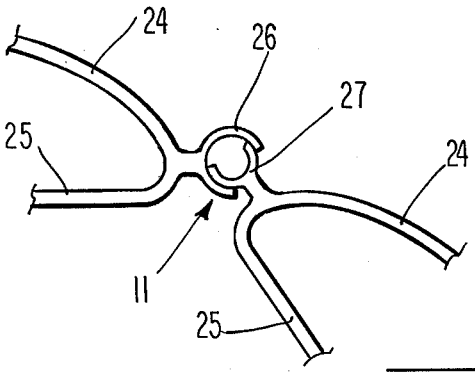
FIG. 6 is a enlarged fragmentary view of pivot means interconnecting adjacent slats.

The slats are extruded and then cut into standard lengths. The standard length sections are put into inventory. For making the panels 5 sections are cut into slats whose length depends upon the size of the aperture which the barrier is to be employed. In joining slats together, the socket section and insert section are axially aligned and then moved toward each other so that they interfit as in FIG. 6 and are axially co-extensive. The number of slats joined together, of course, depends upon the size of the aperture to be covered. In addition to permitting rotation, the pivot means provides for movement in translation necessary for covering and uncovering an aperture. Thur if one of the slats in FIG. 6 is moved left or right the connecting pivot means will cause the other slat to partake of the same motion.

The tracks 6 are identical in construction as will be explained in connection with FIG. 7.

With respect to mounting the slats in the tracks, the invention contemplates means making sliding engagements on both the convex and planar sides of the slats to allow the slats to move in translation while restraining motion normal to the direction of movement so that the motion is smooth and the slats are not jambed while at the same time maintaining an air seal between the slats and the tracks.

The track 5 has hollow compartments 30 and 31 which are oriented at 90 ° to each other and are co-extensive. The track is perferably extruded from rigid PVC plastic and has a wall thickness between 0.050 and 0.060 inches. The track is secured to the wall by strip 32 of foam plastic with an adhesive on both sides. The mounting arrangement provides for the track to accommodate irregularities which may occur in the shape of the window frame or edge. The track has beads 33, 34 and 35.

The end plug 36 includes the insert section 40 which is shaped to conform with the inside shape of the slat 10 and make a tight, sliding fit therewith. The engagement between the insert section and the inside of the plug permits the plug to be removeably press fitted in position. A flange 41 is adapted to engage the end of the slat when the plug is in the position. Extending out from the flange are the pair of circular shaped fingers 42 and 43. The fingers extend in to the compartment 30 and engage the beads 33 and 34. The bead 35 engages the planar sides 25 of the slats.

The dimensions of the slats, fingers and bead spacing are such that the beads making a snug, sliding fit to permit movement in translation and provide that the engagement between bead 35 and planar side 24 constitutes a substantial seal against air passing as between the compartments 30 and 31 and the exterior. The beads 33 and 34 hold the slats against motion normal to the slat axis.

Figure 7:
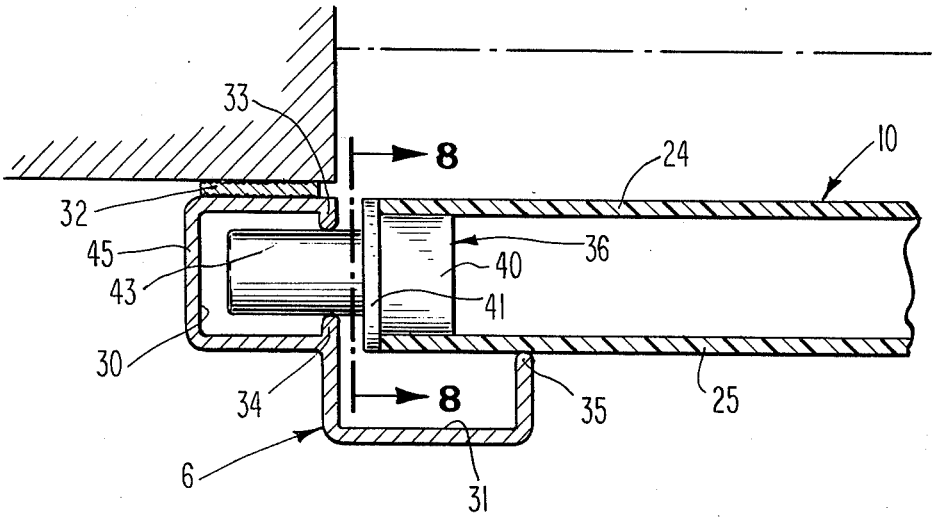
FIG. 7 is an enlarged fragmentary view taken along the lines 7—7 of FIG. 1.

With reference to FIG. 7 it will be observed that the compartment 31 makes a substantial extension over the planar sides 25 of the slats. The amount of the extention of the compartment 31 over the planar sides is advantageous in applying the barrier to apertures where the width may not be constant, for example, in windows of older homes or buildings. In such instances the slats can all be cut to the shortest width. Also note that the ends of the fingers 42 and 43 are spaced from the side 45 of the compartment 30 and the beads 33 and 34 are spaced from the flange 41. This accommodates motion of the slats or panel in a direction left to right viewed in FIG. 71.

When the end plugs 34 are installed in the opposite ends of the slats, the slat interior is sealed and an insulating dead air space is created. The slat provides three insulating mediums, i.e., the sides 24 and 25 (including the pivot means 11) and the dead air space.

As mentioned above the bead 35 acts as a seal and minimizes passage of air between compartment 31 and interior of the room or other structure. Also, it will be noted that the structure of pivot means 11 prevents passage of air between the adjacent slats.

From the foregoing description it will be apparent that the pair of tracks 6 and the slats 10 formed into the panel 5 extending between the tracks constitute a substantially closed thermal barrier.

While I have shown the tracks 6 to be linear it will be appreciated that the tracks may have a curved form.

Figure 10:
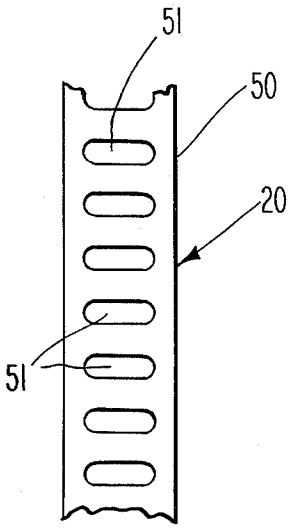
FIG. 10 is a fragmentary view of a belt of the drive system of FIG. 9.
Figure 11:
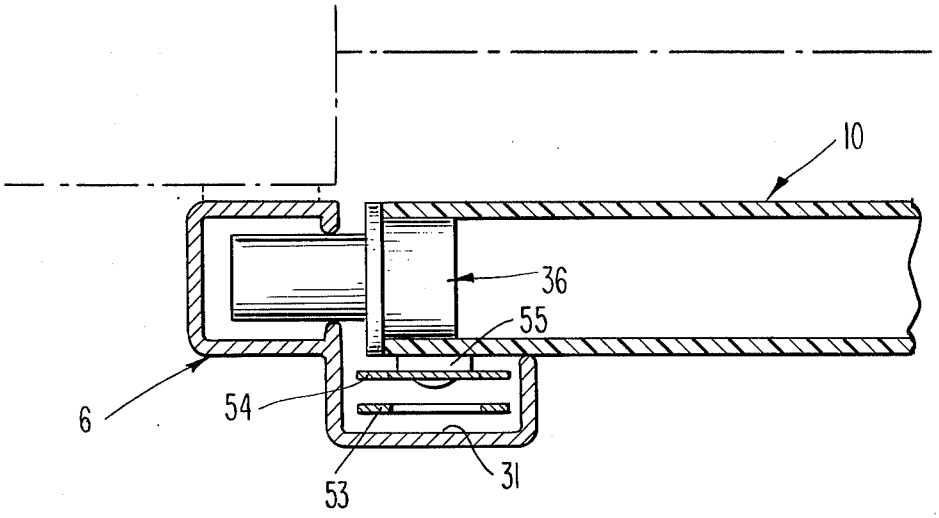
FIG. 11 is a view similar to FIG. 7 and further illustrating the drive system of FIG. 9.

As mentioned heretofore, the panel may be moved as between the open and closed positions either manually or be a motor driven system. The invention contemplates coordinating the track and the drive to provide a reliable arrangement which imparts smooth, positive motion to the panel. The system will be explained in connection with FIGS. 9, 10 and 11.

Figure 9:
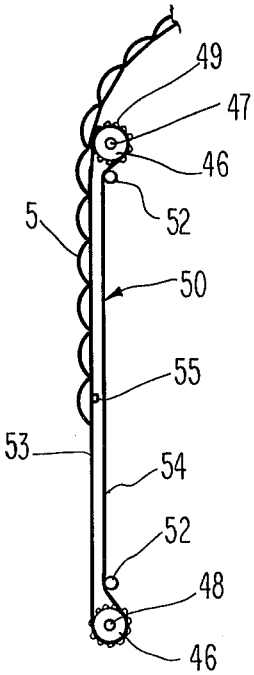
FIG. 9 is a side elevational view diagramatically illustrating a drive system for moving the slats.
Figure 8:
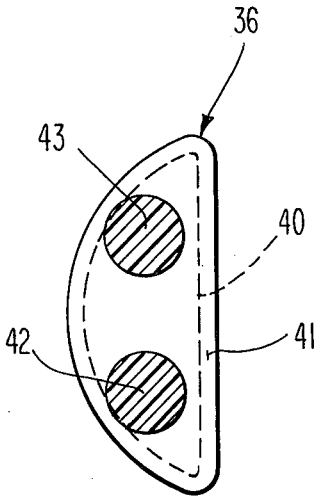
FIG. 8 is a view taken along the lines 8—8 of FIG. 7.

In FIG. 9 a pair of sprockets 45 and 46 are disposed on one side and at the top and bottom of an aperture (not shown). An identical pair are disposed on the opposite side. The top pair of sprockets are fixedly connected to a shaft 47 and the bottom pair fixedly connected to a shaft 48. The sprockets have drive teeth 49. An endless belt 50 is supported by the sprockets and has holes 51 accepting the teeth 49. The belt is positioned and guided by idlers 52. An identical belt is supported on the corresponding sprockets and idlers on the other side of the aperture. The shafts and idlers are rotatably supported by conventional means not shown.

The sprockets and idlers support the belt so that the loop sections 53 and 54 of the belt are close together. This permits the loop sections 53 and 54 to be disposed within the compartment 31 as noted in FIG. 11. Thus, the belt drive is hidden from view.

Preferably, the panel 5 is connected to the drive belts via the bottom-most slat. This is done by connecting the belt and slat by a conventional screw or rivet type fastener indicated at 55.

When the panel 5 is moved to a positon to uncover the aperture of the building or other equipment for which it was used, the invention contemplates that the panel be placed in an appropriate storage medium. This may take the form of additional track means which simply receive the panel and support it in a flat or generally curved condition. For space saving, however, a typical storage means receives the panel and winds the same up into a rool.

A track-type storage medium is diagrammatically illustrated in FIG. 4. The housing 17 has an extention 56, which mounts additional tracks 6 to receive and support the panel 5 for the uncover condition.

Figure 12:
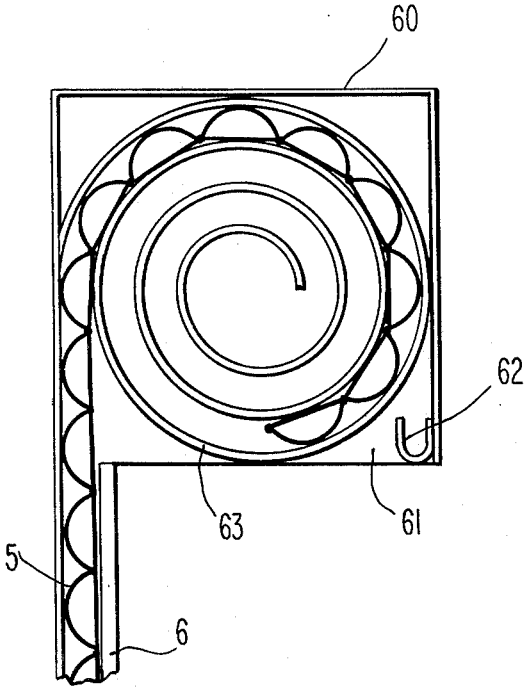
FIG. 12 is a side elevational view diagramatically illustrating a storage means for holding the slats when positioned away from the aperture.

For homes and buildings where decor is a major consideration the storage medium takes the form of a valence box. Typical boxes will be explained in connection with FIGS. 12 and 13.

In FIGS. 21 a box 60 is mounted above the aperture in the wall of the home or building with which the barrier is used. The box has end plates one of which is indicated at 61. Also the box may carry curtain hangers as indicate at 62. As will be noted the box is located at one end of the track so as to receive the moving panel mounted therein.

Within the box is a spiral track 63 which is secured to the box by conventional means or may be molded into the end plate 61. The spiral track is dimentioned to receive the panels and wind the same into a roll as indicated. The pivots between adjacent slats permit the panel to be rolled.

Figure 13:
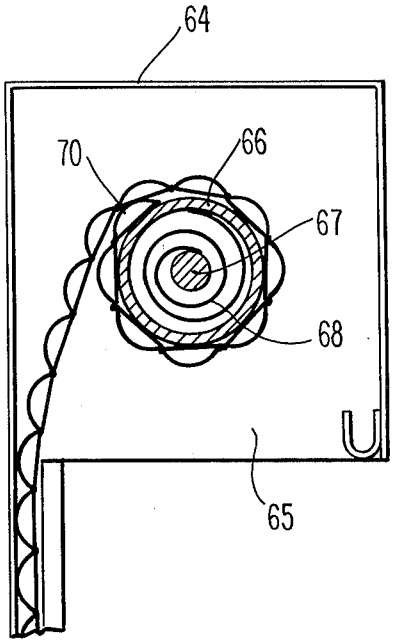
FIG. 13 is a side elevational view diagramatically illustrating another type of storage means.

In FIG. 13 a box 64 is mounted similarly as a box 60. The box has end covers one of which is indicated at 65. Rotatably mounted on the end covers is a drum 66; within the drum and fixedly mounted to the end cover is a rod 67. The spiral spring 68 is disposed between the rod and the drum. The opposite ends of the spring are respectively connected to the rod and drum. Perferably there is a spring adjacent to at each end of the drum and rod. The topmost slat, such as slat 70 is connected to the outside of the drum. When the panel 5 is in the position to close the aperture, the slat 70 occupies substantially the position as shown. The other slats extend downwardly into the tracks.

As indicated, the slats wind themselves around in a spiral fashion on the drum 66 so that when fully stored the panel is arranged in a roll.

When the panel is moved down or in cover position, the spring 68 is wound up so that it exerts a force in a direction to move the panel up to the uncover position. This force assists in manually moving the panel and is particularly desirable for large panels.

Before closing it should be noted that the slats 10 while preferably extruded from PVC may be made of other plastic material such as polycarbonate. Further, in certain applications such as for greenhouses, the slats rather than being opaque may be translucent or transparent.

Also, it is to be noted that while the perferred and most widely used track and slat orientation is as described above, the invention contemplates that the tracks be positioned one above the other so that the slats extend in a vertical direction and move in a horizontal direction.

I claim:

1. In combination with a structure having an aperture providing a means for transmission of thermal energy as between the inside and outside of the structure, thermal barrier for covering and uncovering the aperture comprising;

a pair of tracks, means mounting the tracks adjacent opposite sides of the aperture;

a plurality of elongated, closed, hollow slats extending between the tracks, each slat providing a dead air space and having one side which is planar and the slats being arranged side-by-side and extending parallel with one another;

pivot means connecting adjacent slats and each pivot providing for the slats connected thereto to pivot relative to one another and for the slats to move in unison in translation in a direction generally normal to the axes of the slats;

on the opposite ends of each slat a pair of fingers, each finger extending generally parallel to the slat axis;

each said track including a first hollow compartment co-extensive with the track and having an open side thru which the fingers extend into the compartment, means at the edges of the open side slideably engaging each of said fingers, a second hollow compartment co-extensive with the track and at least a portion of which extends over the ends of the slats and over portions of the contiguous planar sides and means on the second compartment slidingly engaging the planar sides, said engagements providing for the slats to move in translation along the tracks and said engagements on the planar sides each constituting a seal minimizing passage of air therebetween;

said slats, pivots and tracks constituting thermal barrier means and movement of the slats in translation providing for the slats to be positioned to cover the aperture to reduce transmission of thermal energy thru the aperture and to be positioned to uncover the aperture to unimpede said transmission; and storage means for receiving said slats when the slats are positioned to uncover said aperture.

2. The thermal barrier of claim 1 further including for each slat, a pair of end plugs respectively inserted at the opposite ends of the slat and each plug mounting a pair of said fingers.

3. The thermal barrier of claim 1 further including for each track:

an endless flexible drive belt having sprocket holes spaced along its axis and the belt being formed into a loop;

a pair of sprockets respectively rotatably mounted above and below said aperture and mounting said belt;

on at least one sprocket, a plurality of drive fingers engaged with said holes and the rotation of said one sprocket causing the belt to move in translation; and means on at least one slat connectng the slat with the drive belt so that translatory motion of the belt imparts translatory motion to all of the slats.

4. The thermal barrier of claim 3 wherein each compartment is C-shaped in cross section and the compartments are oriented generally at 90 ° to one another.

5. The thermal barrier of claim 3 wherein portions of said loops are disposed in said second compartment.

* * * * *